United States Patent [19]

Fitzpatrick

[11] Patent Number: 4,826,157

[45] Date of Patent: May 2, 1989

[54] PHYSICAL EXERCISING APPARATUS

[76] Inventor: Patrick C. Fitzpatrick, 82 Calle Pensamiento, El Paraiso Baja, Estepona, Marbella, Spain

[21] Appl. No.: 125,442

[22] Filed: Nov. 25, 1987

[30] Foreign Application Priority Data

Dec. 10, 1986 [GB] United Kingdom ..... 8629531

[51] Int. Cl.[4] ..... A63B 21/00

[52] U.S. Cl. ..... 272/134; 272/118; 272/144

[58] Field of Search ..... 272/117, 118, 130, 134, 272/144, DIG. 4, 123, 145

[56] References Cited

U.S. PATENT DOCUMENTS

| | | | |
|---|---|---|---|
| 2,632,645 | 3/1953 | Barkschat | 272/118 |
| 4,072,309 | 2/1978 | Wilson | 272/144 X |
| 4,098,502 | 7/1978 | Faust | 272/144 |
| 4,241,915 | 12/1980 | Noble et al. | 272/144 X |
| 4,316,609 | 2/1982 | Silberman | 272/118 |
| 4,358,109 | 11/1982 | Schrems | 272/134 X |
| 4,492,375 | 1/1985 | Connelly | 272/144 X |
| 4,546,967 | 10/1985 | Kecala | 272/144 X |
| 4,620,704 | 11/1986 | Shifferaw | 272/134 X |
| 4,634,127 | 1/1987 | Rockwell | 272/134 |
| 4,645,205 | 2/1987 | Wolff | 272/134 X |
| 4,667,955 | 5/1987 | Giesch | 272/134 X |
| 4,712,791 | 12/1987 | Edwards | 272/134 X |
| 4,721,303 | 1/1988 | Fitzpatrick | 272/134 X |

FOREIGN PATENT DOCUMENTS

| | | | |
|---|---|---|---|
| 8202392 | 6/1982 | Fed. Rep. of Germany . | |
| 3221446 | 12/1983 | Fed. Rep. of Germany | 272/144 |
| 3417719 | 11/1985 | Fed. Rep. of Germany | 272/144 |
| 3432837 | 1/1986 | Fed. Rep. of Germany . | |
| 2554195 | 5/1985 | France | 272/134 |
| WO86/04511 | 8/1986 | PCT Int'l Appl. . | |
| 2170413 | 8/1986 | United Kingdom | 272/134 |

*Primary Examiner*—Richard J. Apley
*Assistant Examiner*—Robert W. Bahr
*Attorney, Agent, or Firm*—Mason, Fenwick & Lawrence

[57] ABSTRACT

A physical exercising device including a body, and an exercise bench mounted on the body, the bench mounting including an attachment on the bench adjacent to one end thereof and adapted to be attached to the body at any one of at least two different heights, the attachment also being adapted to permit inclination of the bench relative to the horizontal, and a leg arranged to support the bench at a position spaced from the one end and the lower end of the leg is adapted to be secured to the body, the arrangement being such that the position of attachment of the leg on the body can be adjusted to vary the height of the end of the bench opposite to the said one end, whereby both ends of the bench can be raised and lowered independently so that the bench can be inclined in opposite directions and whereby the bench can assume different horizontal heights.

17 Claims, 5 Drawing Sheets

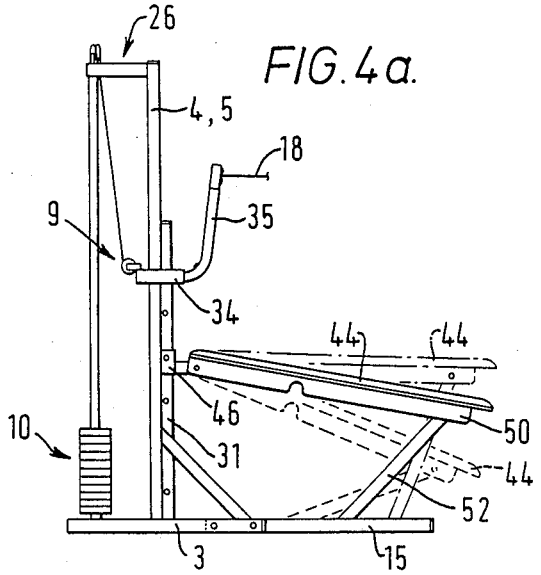
FIG. 4a.
FIG. 4b.
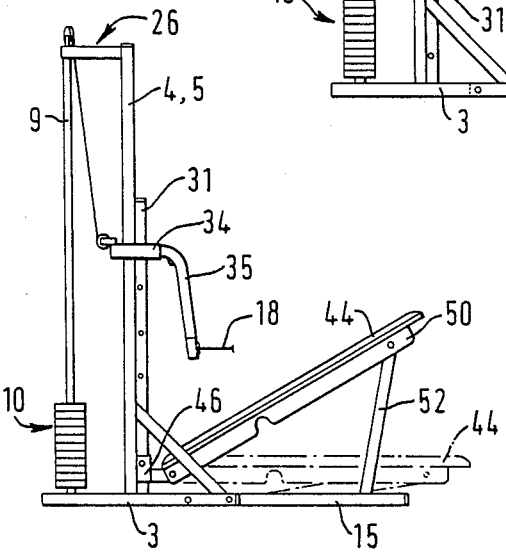
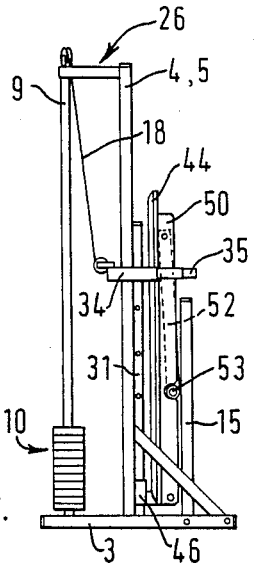
FIG. 4c.

PHYSICAL EXERCISING APPARATUS

The invention relates to physical exercising apparatus.

One well known form of physical exercising apparatus comprises a bench on which the user sits or lies during exercise. It is an object of the invention to provide an exercise bench of improved versatility. It is also among the objects of the invention to provide improvements in convertible exercisers of the kind described in International Patent Application No. PCT/GB86/00055 (Publication No. WO86/04511).

From one aspect the invention is a physical exercising device comprising a body, an exercise bench, and means mounting the bench on the body, the bench mounting means comprising attachment means on the bench adjacent to one end thereof and adapted to be attached to the body at any one of at least two different heights, the attachment means also being adapted to permit inclination of the bench relative to the horizontal, and leg means arranged to support the bench at a position spaced from the said one end an the lower end of which leg means is adapted to be secured to the body, the arrangement being such that the position of attachment of the leg means on the body can be adjusted to vary the height of the end of the bench opposite to the said one end, whereby both ends of the bench can be raised and lowered independently so that the bench can be inclined in opposite directions and whereby the bench can assume different horizontal heights.

From another aspect the present invention is a physical exercising device comprising a body, an exercise bench, means mounting the bench on the body so that the bench is adjustable in height and in inclination, the bench mounting means comprising attachment means pivotally mounted on one end of the bench and adapted to be attached to the body at any one of at least two different heights, and leg means the upper end of which is pivotally attached to the bench and the lower end of which is adapted to be secured to the body at ny one of at least two different lateral positions, the arrangement being such that both ends of the bench can be raised and lowered independently whereby the bench can assume different horizontal heights and can also be inclined in opposite directions. Preferably the bench can be lowered to assume a generally horizontal position at around ground level. It is also preferred that the bench can be inclined to at least two different angles in opposite directions.

Preferably the body comprises a member on which the attachment means is vertically slidable, and preferably means are provided for releasably securing the attachment means to the member in one of at least two vertically spaced positions. The attachment means may comprise a tubular member which embraces and is slidable on the slide member, the tubular member carrying a spring biased detent pin adapted to engage selectively in corresponding bores provided along the member.

Preferably the attachment means carries a cross-piece disposed adjacent to the one end of the bench and adapted to be engaged by a user during exercise. Thus for example the user can grasp the cross-piece in his hands while lying on the bench or alternatively the user can hook his feet under the cross-piece while seated or lying on the bench.

The pivotal connection of the attachment means to the one end of the bench is preferably a pin articulation which connects to a longitudinal bench support member whereby the bench can be pivoted in a generally vertical plane. The leg means may comprise a single leg pivoted to the bench for movement in a generally vertical plane, and the lower end of the leg may be provided with a cross-member, the opposite ends of which engage the body and are supported thereon. Preferably a spaced series of abutments are provided on the body and with which the leg means can be selectively engaged.

Preferably the body is provided near to its base with a folding extension which can be pivoted between a generally horizontal ground engaging position and a generally vertical storage position, which folding extension is engaged by the lower end of the leg means to support the leg means The folding extension is preferably adapted to be releasably fixed in its horizontal position of use.

From another aspect a physical exercising device of the kind set out above comprises a movable member on the body and adapted to be engaged and moved by a user from a rest position, resistance means providing resistance to movement of the movable member, an elongate flexible element operatively coupling the movable member and the resistance means so that resistance force is exerted on said movable member through said elongate flexible element, a final guide over which the elongate flexible element is trained, support means supporting the final guide which support means is pivotally mounted on the body for movement in an arc about a substantially horizontal axis for permitting the support means to be positioned in a plurality of different angular positions relative to the body, whereby the position of the final guide on the body can be adjusted to vary the rest position of the movable member to permit the movable member to be moved in various different planes from its various rest positions to vary the direction of force exerted by the elongate flexible element on the movable member so that the exercising device can be used to perform a range of different exercises.

Preferably a pair of the movable members is operatively associated with the body and is adapted to be engaged and moved by the user from rest positions. Advantageously the resistance means comprises a single weight stack and a single elongate flexible element is operatively associated with the weight stack and with the pair of movable members, a carrier member being provided and on which the weight stack is detachably carried, the carrier member having a guide over which an intermediate portion of the elongate flexible element is trained. In this way the pair of movable members may be moved by the user either together or separately to exercise using only one weight stack.

The invention is diagrammatically illustrated by way of example in the accompanying drawings in which.

Figure 1:
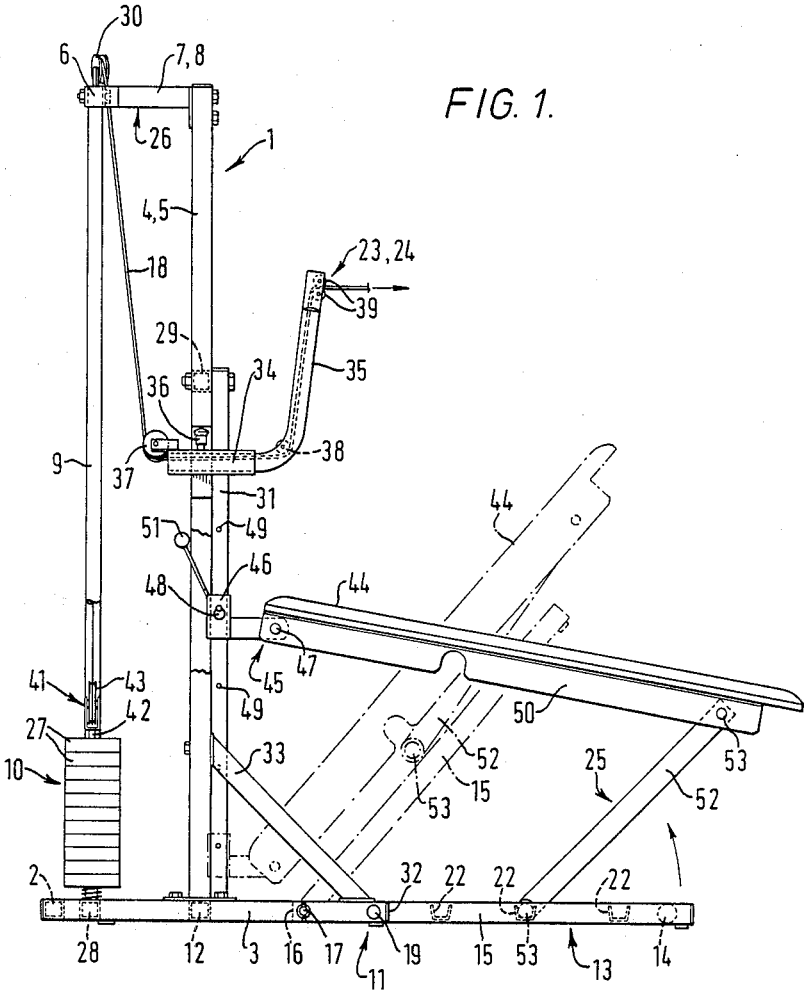
FIG. 1 is a side elevation of a first embodiment of exercise device.
Figure 2:
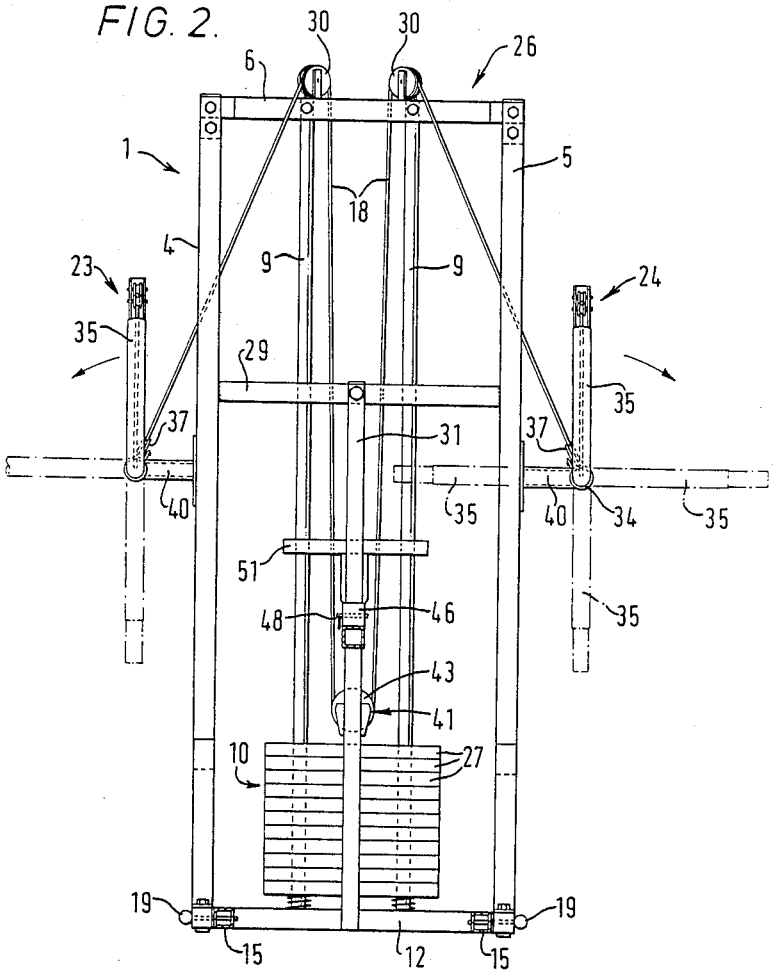
FIG. 2 is a front view of the exercise device shown in FIG. 1.
Figure 3:
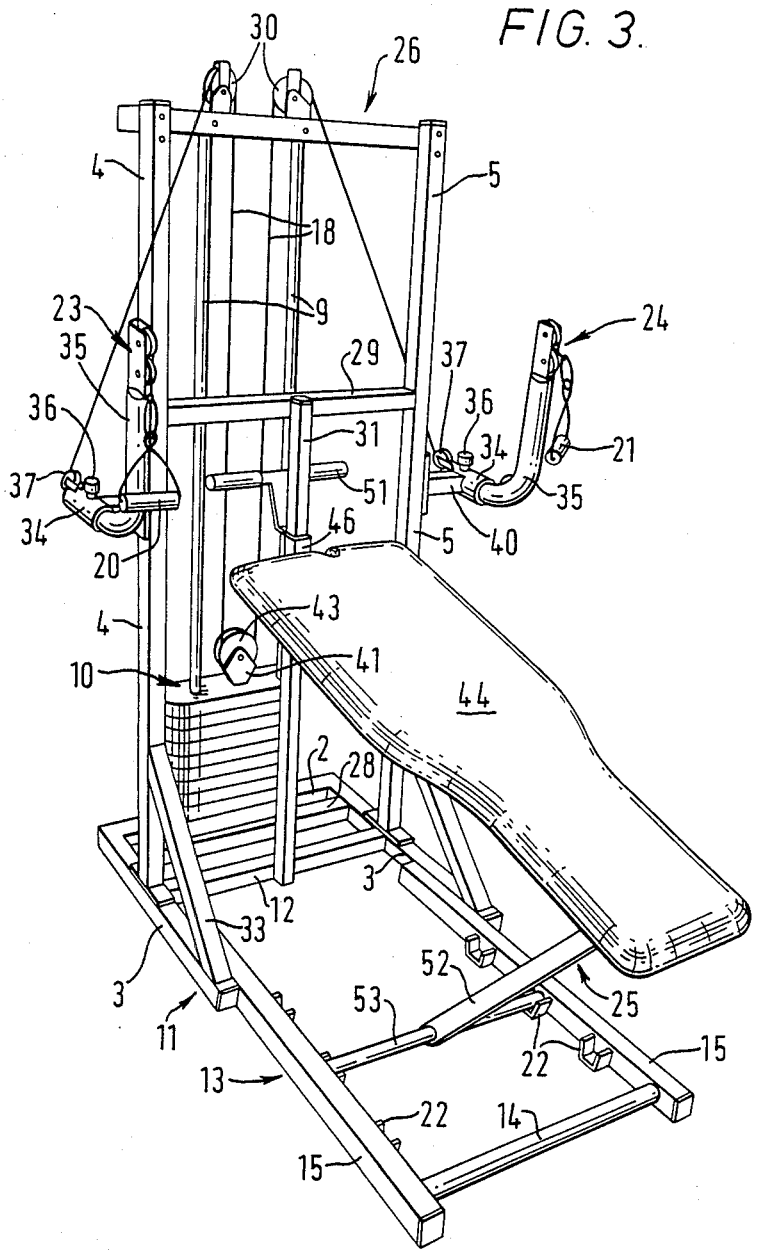
FIG. 3 is a perspective view of the exercise device of FIGS. 1 and 2.
Figure 5:
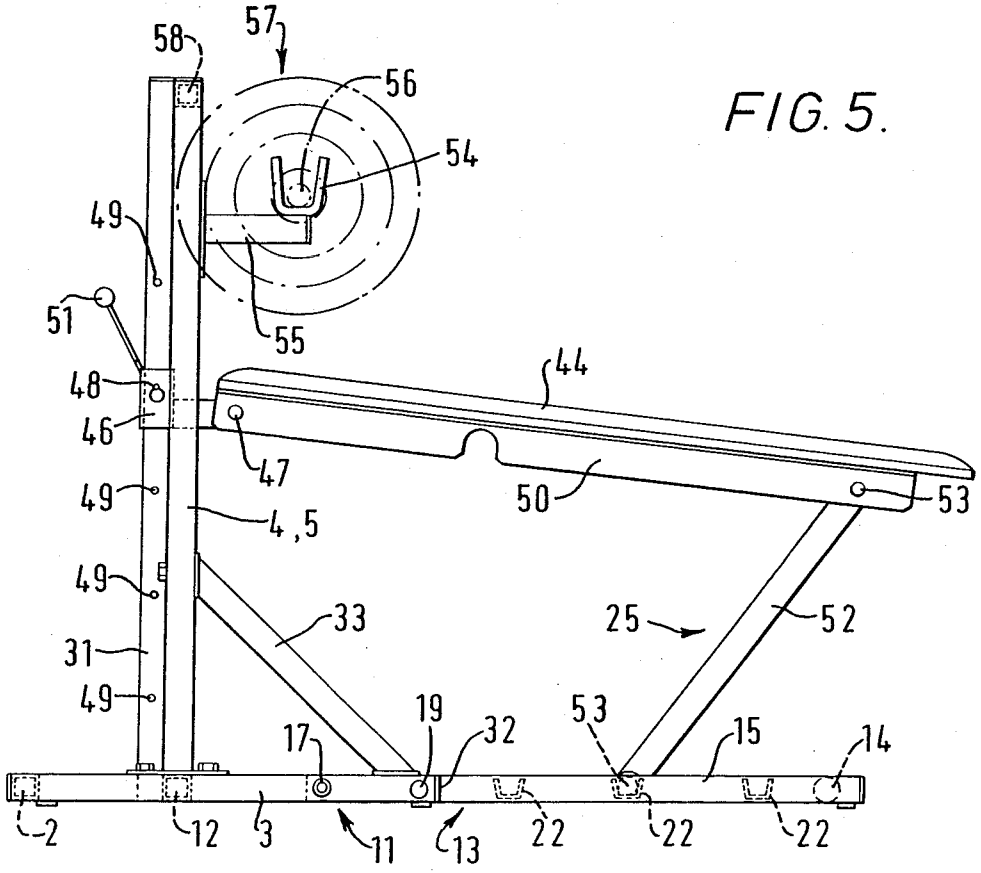

FIGS. 4*a*, 4*b* and 4*c* are sketches of the device of FIGS. 1 to 3 in various different positions, and FIG. 5 is a perspective view of a free-weight bench.

In the drawings, and referring more particularly to FIGS. 1 to 4 thereof, there is shown a weight actuated convertible physical exercising device of the general kind shown and described in International Patent Application PCT/GB86/00055. The device comprises a body in the form of a frame 1 made from square section tube united by bolts, although other tube sections are possible and it would of course be possible to weld the frame parts together. The frame 1 comprises a ground engaging portion 11 which is generally U-shaped and consists of a straight rear frame member 2 from which extend forwardly a parallel pair of frame members 3. A cross member 12 is connected between the frame members 3, the cross member being parallel to the rear frame member 2 and being disposed at around mid-way between the respective ends of the frame members 3.

The ground engaging portion 11 of the frame also comprises a forward extension 13 which is generally U-shaped and which consists of a tubular cross member 14 at a forward position to which are connected a parallel pair of side members 15 which are pivoted adjacent to their free ends 16 to the respective frame members 3 by means of hinge pins 17 whereby the forward extension 13 can be swung between a ground engaging generally horizontal position of use as shown in FIG. 1 for example and a generally vertical folded storage position as shown in FIG. 4*c*. The forward extension 13 can be fixed in its ground engaging position of use by means of a pair of pull pins 19 which can be releasably engaged in registering bores in the side members 15 and in the respective frame members 3.

The side members 15 are formed along their lengths with pairs of abutments 22, advantageously formed as open topped cradles, for receiving and supporting a bench leg means 25 more fully described below.

At a position on the members 3 adjacent to the cross member 12 are attached a pair of upright members 4 and 5 respectively, which at their upper ends carry the ends of a rearwardly extending generally U-shaped member 26 which comprises a pair of horizontal limbs 7 and 8 respectively and an interconnecting horizontal member 6 which is positioned vertically above a cross member 28 connected between the frame members 3 and which member 28 is parallel to and adjacent to the rear member 2. Between the vertically superposed members 28 and 6 are supported a parallel pair of tubular guides 9 on which slide a stack 10 of weights 27 in a manner known per se. The upright members 4 and 5 are supported by a pair of braces 33 attached to the upright members and to the forward ends 32 of the frame members 3.

At a position midway along the upright members 4 and 5 they are united by a cross member 29 which supports the upper end of a centrally disposed bench support column 31, the lower end of which column 31 is connected to the cross member 12. A pair of mutually outwardly projecting brackets 40 are also secured to the upright members 4 and 5 around half-way along their lengths, the brackets carrying tubular sleeves 34 which are disposed with their axes mutually parallel and parallel to the frame members 3. A pair of cranked tubular arms 35 are snugly mounted adjacent to one end in the respective sleeves 34 so that the arms can rotate in the sleeves through 360 degrees. Each of the arms can be fixed against rotation in the respective sleeve in several different positions of rotation, e.g. in eight equispaced positions, by means of a securing device consisting of a pull pin 36 mounted on the sleeve and arranged to engage selectively in any one of a number of corresponding apertures (not shown) pierced through the wall of the tubular arm.

Each of the brackets 40 for the sleeves has an intermediate guide pulley 37 mounted thereon adjacent to one end of the cranked tubular arm and a further guide pulley 38 is mounted at the bend of each cranked arm 35. A pair of guide pulleys 39 is mounted at the free end of each tubular cranked arm and constitute respective final guides 23, 24.

The weight stack 10 is connected to respective user handles 20 and 21, which as shown in FIG. 3 are formed as stirrups, by means of an elongate flexible element 18 which may for example be a cable, rope or cord. The individual weights 27 which make up the weight stack 10 are releasably connected to a carrier 41 in the form of a tubular rod 42 which extends through corresponding aligned bores (not shown) in the weights, by means of a pin (not shown) which engages the weights and which engages in a cross bore (not shown) in the tubular rod. This arrangement is well known in the art. The upper end of the tubular rod carries a guide pulley 43 for the flexible element 18.

The elongate flexible element 18 is trained over the guide pulley 43 on the weight stack carrier 41, over a pair of guide pulleys 30 mounted on the U-shaped member 26 above the weight stack 10 after which the elongate flexible element 18 is trained over the intermediate guide pulleys 37 on the brackets 40 on the upright members 4 and 5 respectively. The elongate flexible member 18 is then trained through the tubular arms 35, over the guide pulleys 38 provided at the bends of the arms and between the pairs of guide pulleys 39 which form the final guides 23, 24. The ends of the element 18 may be terminated with user handles such as those shown at 20, 21 in FIG. 3, or by any other user handle such as a bar resembling a weight bar, a wrist cuff or an ankle strap.

An exercise bench 44 is mounted on the frame 1 and is arranged so that both of its ends can be raised and lowered independently of the other end of the bench whereby the bench can be mounted at different vertical heights from floor level upwards and can be inclined at different angles and in opposite directions as indicated in FIGS. 4*a* and 4*b*. For this purpose the bench 44 is mounted on a support 50 in the form of a beam and one end 45 of the bench support is articulated at 47 on a sleeve member 46 which is slidable up and down the bench support column 31 and which can be releasably fixed to the column 31 in several different vertical positions by means of a pin 48 which engages the sleeve 46 and with any one of several bores 49 provided down the column. The sleeve member 46 carries a cross-bar or T piece 51 which presents a pair of handles which may be engaged by the user to facilitate bench exercises.

The other end of the bench is supported on leg means 25 comprising a single central strut 52, the upper end of which is pivoted at 53 to the bench support 50 and the lower end of which carries a cross-bar 53 the ends of which can be engaged selectively in any of the pairs of cradle shaped abutments 22 on the forward extension 13 of the ground engaging portion of the frame 1. The bench supporting leg may thus be fixed in various lateral positions along the forward extension so that the attitude of the bench can be changed. The attitude of the bench is also changed by moving the front of the bench up or down the column 31. Different positions of the bench are shown in FIG. 4. Thus FIG. 4*a* shows in full lines the bench inclined forwardly to a slight extent, and in dotted lines the bench disposed horizontally and inclined forwardly steeply; FIG. 4*b* shows in full lines the bench steeply inclined rearwardly and in dotted lines disposed horizontally at around floor level, and FIG. 4*c* shows the device folded for storage with the bench arranged vertically and the extension 13 swung into a vertical position. The bench and extension 13 may be retained in the folded position by moving the arms 35 into their inner position.

The free-weight bench apparatus shown in FIG. 5 of the drawings is generally similar to that described above and employs an adjustable bench similar to that of FIGS. 1 to 4 of the drawings. Thus the free weight bench comprises a body in the form of a frame 1 made from square section tube. The frame 1 comprises a ground engaging portion 11 which is generally U-shaped and consists of a straight rear frame 2 from which extend forwardly a parallel pair of frame members 3. A cross member 12 is connected between the frame members 3, the cross member being parallel to the rear frame member 2 and being disposed at around mid-way between the respective ends of the frame members 3.

The ground engaging portion 11 of the frame also comprises a forward extension 13 which is generally U-shaped and which consists of a tubular cross member 14 at a forward position to which are connected a parallel pair of side members 15 which are pivoted adjacent to their free ends 16 to the respective frame members 3 by means of hinge pins 17 whereby the forward extension 13 can be swung between a ground engaging generally horizontal position of use and a generally vertical folded storage position in the manner described above with reference to FIGS. 1 to 4. The forward extension 13 can be fixed in its ground engaging position of use by means of a pair of pull pins 19 which can be releasably engaged in registering bores in the side members 15 and in the respective frame members 3.

The side members 15 are formed along their lengths with pairs of abutments 22, formed as open topped cradles, for receiving and supporting a bench leg means 25 more fully described below.

At a position on the members 3 adjacent to the cross member 12 are attached a pair of upright members 4 and 5 respectively, which at their upper ends are united by a cross member 58. The upright members 4 and 5 are supported by a pair of braces 33 attached to the upright members and to the forward ends 32 of the frame members 3.

The cross member 58 supports the upper end of a centrally disposed bench support column 31, the lower end of which column 31 is connected to the cross member 12. Thus the bench can adopt all of the different attitudes shown in FIG. 4 with reference to the embodiment of FIGS. 1 to 3. However in the present embodiment, instead of the weight stacks and associated cable guides, a pair of cradles 54 are mounted on brackets 55 adjacent to the upper ends of the upright members 4, 5 for supporting the bar 56 of a barbell assembly 57.

I claim:

1. In a physical exercising device comprising a body, an exercise bench, and means mounting the bench on the body, the bench mounting means comprising attachment means on the bench adjacent to one end thereof and adapted to be attached to the body at any one of at least two different heights, the attachment means also being adapted to permit inclination of the bench relative to the horizontal, and leg means arranged to support the bench at a position spaced from the said one end and the lower end of which leg means is secured to the body, the improvement which comprises means for adjusting the position of securement of the leg means to the body to vary the height of the end of the bench opposite to the said one end, whereby both ends of the bench can be raised and lowered independently so that the bench can be inclined in opposite directions and whereby the bench can assume different horizontal heights.

2. A physical exercising device according to claim 1, wherein the body comprises a member on which the attachment means is vertically slidable, and comprising means for releasably securing the attachment means to the vertical member in one of at least two vertically spaced positions.

3. A physical exercising device according to claim 2, wherein the attachment means comprises a tubular member which embraces and is slidable on the member, the tubular member carrying a pin adapted to engage selectively in corresponding bores provided along the member.

4. A convertible physical exercising device according to claim 1, wherein the attachment means carries a cross-piece disposed adjacent to the one end of the bench and adapted to be engaged by a user during exercise.

5. A convertible physical exercising device according to claim 1, wherein the leg means comprises a single leg pivoted to the bench for movement in a generally vertical plane, the lower end of the leg being provided with a cross-member, the opposite ends of which engage the body and are supported thereon.

6. A convertible physical exercising device according to claim 5, comprising a spaced series of abutments on the body and with which the leg means can be selectively engaged.

7. A convertible physical exercising device according to claim 6, wherein the body comprises a ground engaging portion and a folding extension pivoted on the body for movement between a generally horizontal ground engaging position and a generally vertical storage position, which folding extension carries the said abutments for engagement by the lower end of the leg means to support the leg means.

8. A convertible physical exercising device according to claim 7, comprising means for releasably fixing the folding extension in its horizontal position of use.

9. A physical exercising device according to claim 1, comprising a movable member on the body and adapted to be engaged and moved by a user from a rest position, resistance means providing resistance to movement of the movable member, an elongate flexible element operatively coupling the movable member and the resistance means so that resistance force is exerted on said movable member through said elongate flexible element, a final guide over which the elongate flexible element is trained, support means supporting the final guide which support means is pivotally mounted on the body for movement in an arc about a substantially horizontal axis for permitting the support means to be positioned in a plurality of different angular positions relative to the body, whereby the position of the final guide on the body can be adjusted to vary the rest position of the movable member to permit the movable member to be moved in various different planes from its various rest positions to vary the direction of force exerted by the elongate flexible element on the movable member so that the exercising device can be used to perform a range of different exercises.

10. A physical exercising device according to claim 9, comprising a pair of movable members operatively associated with the body and adapted to be engaged and moved by a user from rest positions.

11. A convertible physical exercising device according to claim 10, wherein the resistance means comprises a single weight stack and wherein a single elongate flexible element is operatively associated with the weight stack and with the pair of movable members, and comprising a carrier member on which the weight stack is detachably carried, and a guide on the carrier member, the arrangement being such that an intermediate portion of the elongate flexible element is trained over the guide on the carrier member.

12. In a physical exercising device comprising a body, an exercise bench, means mounting the bench on the body so that the bench is adjustable in height and in inclination, the bench mounting means comprising attachment means pivotally mounted on one end of the bench and adapted to be attached to the body at any one of at least two different heights, and leg means the upper end of which is pivotally attached to the bench, the improvement which comprises means for securing the lower end of the leg means to the body at any one of at least two different lateral positions, the arrangement being such that both ends of the bench can be raised and lowered independently whereby the bench can assume different horizontal heights and can also be inclined in opposite directions.

13. A convertible physical exercising device according to claim 12, wherein the pivotal connection of the attachment means to the one end of the bench is a pin articulation which connects to a longitudinal bench support member whereby the bench can be pivoted in a generally vertical plane.

14. A physical exercising device according to claim 12, wherein the body comprises a member on which the attachment means is vertically slidable, and comprising means for releasably securing the attachment means to the vertical member in one of at least two vertically spaced positions.

15. A convertible physical exercising device according to claim 12, wherein the leg means comprises a single leg pivoted to the bench for movement in a generally vertical plane, the lower end of the leg being provided with a cross-member, the opposite ends of which engage the body and are supported thereon.

16. A physical exercising device according to claim 12, comprising a movable member on the body and adapted to be engaged and moved by a user from a rest position, resistance means providing resistance to movement of the movable member, an elongated flexible element operatively coupling the movable member and the resistance means so that resistance force is exerted on said movable member through said elongate flexible element, a final guide over which the elongate flexible element is trained, support means supporting the final guide which support means is pivotally mounted on the body for movement in an arc about a substantially horizontal axis for permitting the support means to be positioned in a plurality of different angular positions relative to the body, whereby the position of the final guide on the body can be adjusted to vary the rest position of the movable member to permit the movable member to be moved in various different planes from its various rest positions to vary the direction of force exerted by the elongate flexible element on the movable member so that the exercising device can be used to perform a range of different exercises.

17. A convertible physical exercising device comprising a body, a movable member on the body and adapted to be engaged and moved by a user from a rest position, resistance means providing resistance to movement of the movable member, an elongate flexible element operatively coupling the movable member and the resistance means so that resistance force is exerted on said movable member through said elongate flexible element, a final guide over which the elongate flexible element is trained, support means supporting the final guide which support means is pivotally mounted on the body for movement in an arc about a substantially horizontal axis for permitting the support means to be positioned in a plurality of different angular positions relative to the body, whereby the position of the final guide on the body can be adjusted to vary the rest position of the movable member to permit the movable member to be moved in various different planes from its various rest positions to vary the direction of force exerted by the elongate flexible element on the movable member so that the exercising device can be used to perform a range of different exercises, an exercise bench, and means mounting the bench on the body so that the bench is adjustable in height and in inclination, the bench mounting means comprising attachment means pivotally mounted on one end of the bench, a member on the body and on which the attachment means is vertically slidable, and means for releasably securing the attachment means to the vertical frame member in one of several vertically spaced positions, and leg means the upper end of which is pivotally attached to the bench and means for securing the lower end of said leg means to the body at any one of at least two different lateral positions, the arrangement being such that both ends of the bench can be raised and lowered independently whereby the bench can assume different horizontal heights and can also be inclined in opposite directions.

* * * * *